US008162473B2

(12) United States Patent
Sakano

(10) Patent No.: US 8,162,473 B2
(45) Date of Patent: Apr. 24, 2012

(54) IMAGE RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1008 days.

(21) Appl. No.: 12/058,618

(22) Filed: Mar. 28, 2008

(65) Prior Publication Data

US 2008/0239053 A1 Oct. 2, 2008

(30) Foreign Application Priority Data

Mar. 29, 2007 (JP) ..... 2007-089615
Mar. 18, 2008 (JP) ..... 2008-068749

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 5,165,679 | A | 11/1992 | Kinomoto | |
| 2006/0050126 | A1 | 3/2006 | Tanaka et al. | |
| 2006/0238596 | A1 * | 10/2006 | Mitsuhashi et al. | 347/104 |

FOREIGN PATENT DOCUMENTS

| | | | |
|---|---|---|---|
| JP | S59-224858 | A | 12/1984 |
| JP | H01-187143 | A | 7/1989 |
| JP | H04-106045 | A | 4/1992 |
| JP | H08-231074 | A | 9/1996 |
| JP | 3031630 | U | 11/1996 |
| JP | 2000-355431 | A | 12/2000 |
| JP | 2001233529 | A | 8/2001 |
| JP | 2001-302012 | A | 10/2001 |
| JP | 2005-075475 | A | 3/2005 |
| JP | 2005-089076 | A | 4/2005 |
| JP | 2005089076 | A * | 4/2005 |
| JP | 2006-103969 | A | 4/2006 |
| JP | 2006-232500 | A | 9/2006 |
| JP | 2006256790 | A | 9/2006 |

OTHER PUBLICATIONS

European Patent Office, European Search Report for European Patent Application No. EP08005980 (counterpart to above-captioned patent application), dated Jul. 16, 2008.
Japan Patent Office, Notice of Reasons for Rejection for Japanese Patent Application No. 2008-068749 (counterpart to above-captioned patent application), mailed Nov. 29, 2011.

* cited by examiner

*Primary Examiner* — Kendrick Liu
(74) *Attorney, Agent, or Firm* — Baker Botts L.L.P.

(57) ABSTRACT

An image recording apparatus includes a recording head, first and second rollers, an endless conveyor belt wound around the first and second rollers to convey a recording medium from the first to the second roller, a first adsorber giving adsorptivity for the recording medium toward an outer surface of the conveyor belt at least in a region thereof opposed to the recording head, a third roller disposed at a position opposite to the first roller across the second roller, and an endless separation belt wound around the second and third rollers. An outer surface of the endless separation belt has adsorptivity lower than the adsorptivity given by the first adsorber. The endless separation belt receives the recording medium from the conveyor belt and conveys the recording medium from the second roller to the third roller while supporting the recording medium on the surface thereof.

22 Claims, 6 Drawing Sheets

IMAGE RECORDING APPARATUS

CROSS REFERENCE TO RELATED APPLICATION

The present application claims priority from Japanese Patent Applications No. 2007-089615 which was filed on Mar. 29, 2007 and No. 2008-068749 which was filed on Mar. 18, 2008, the disclosures of which are herein incorporated by reference in their entirety.

BACKGROUND OF THE INVENTION

1. Field of the Invention

The present invention relates to an image recording apparatus which records an image on a recording medium.

2. Description of Related Art

In an image recording apparatus including a conveyor belt, particularly when the conveyor belt has relatively high adsorptivity toward a recording medium, the recording medium may not be properly separated from the conveyor belt at a downstream end part of the conveyor belt with respect to a conveyance direction. As a result, jamming may occur. Therefore, various proposals have been made for ensuring that a recording medium is separated from a conveyor belt. For example, Japanese Unexamined Patent Publication No. 2006-256790 discloses an ink-jet recording apparatus including five conveyor belts and a comb-like separation guide. The five conveyor belts convey recording media while supporting the recording media on their outer surfaces by electrostatic adsorption. The comb-like separation guide is disposed on a downstream of the conveyor belts with respect to a conveyance direction. The separation guide separates a recording medium from the conveyor belt by coming into contact with a back surface of the recording medium which is being conveyed by the conveyor belt.

SUMMARY OF THE INVENTION

The recording medium separated from the conveyor belt by the separation guide is conveyed while being pinched between a pair of rollers which are disposed on a downstream of the separation guide with respect to the conveyance direction, and then discharged to outside. At this time, an upper roller may touch a surface of the recording medium, that is, a recording surface, which may damage the recording surface. As a result, recording quality may deteriorate. Moreover, when a leading edge of the recording medium touches the upper roller, the pair of rollers may not properly pinch the recording medium, and as a result jamming may occur. Here, devising how the recording medium can be properly pinched between the pair of rollers requires additional members, which makes a structure complicated.

An object of the present invention is to provide an image recording apparatus in which a recording medium can be surely separated from an outer surface of a conveyor belt, damage to a recording surface of the recording medium can be prevented, and in addition jamming can be prevented.

According to a first aspect of the present invention, there is provided an image recording apparatus comprising a recording head, first and second rollers, an endless conveyor belt, a first adsorber, a third roller, and an endless separation belt. The recording head records an image on a recording medium. The first and second rollers respectively have rotation shafts parallel to each other. The endless conveyor belt is wound around the first and second rollers to be stretched between them, and conveys the recording medium from the first roller to the second roller while supporting the recording medium on an outer surface thereof. The first adsorber gives adsorptivity for the recording medium toward the outer surface of the conveyor belt at least in a region thereof opposed to the recording head. The third roller has a rotation shaft parallel to the rotation shafts of the first and second rollers, and is disposed at a position opposite to the first roller across the second roller. The endless separation belt is wound around the second and third rollers to be stretched between them. An outer surface of the endless separation belt has adsorptivity lower than the adsorptivity given by the first adsorber. The endless separation belt receives the recording medium from the conveyor belt and conveys the recording medium from the second roller to the third roller while supporting the recording medium on the surface thereof.

In the aspect, the recording medium which has been conveyed while being supported on the outer surface of the conveyor belt moves onto the outer surface of the separation belt, so that the recording medium is surely separated from the outer surface of the conveyor belt. The separation belt serves not only to separate the recording medium from the conveyor belt but also to convey the recording medium further to the outside. Thus, the recording medium separated from the conveyor belt is conveyed to the outside not by a pair of rollers as disclosed in the above-mentioned patent publication, but by the separation belt. Therefore, it is not necessary to provide such pair of rollers. As a result, problems involved in a pair of rollers, such as damage to a recording surface of the recording medium, jamming, and the like, can be avoided. In addition, since adsorptivity of the outer surface of the separation belt is lower than the adsorptivity given by the first adsorber, it is easy for the recording medium to be separated from the outer surface of the separation belt.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, some preferred embodiments of the present invention will be described with reference to the accompanying drawings.

Figure 1:
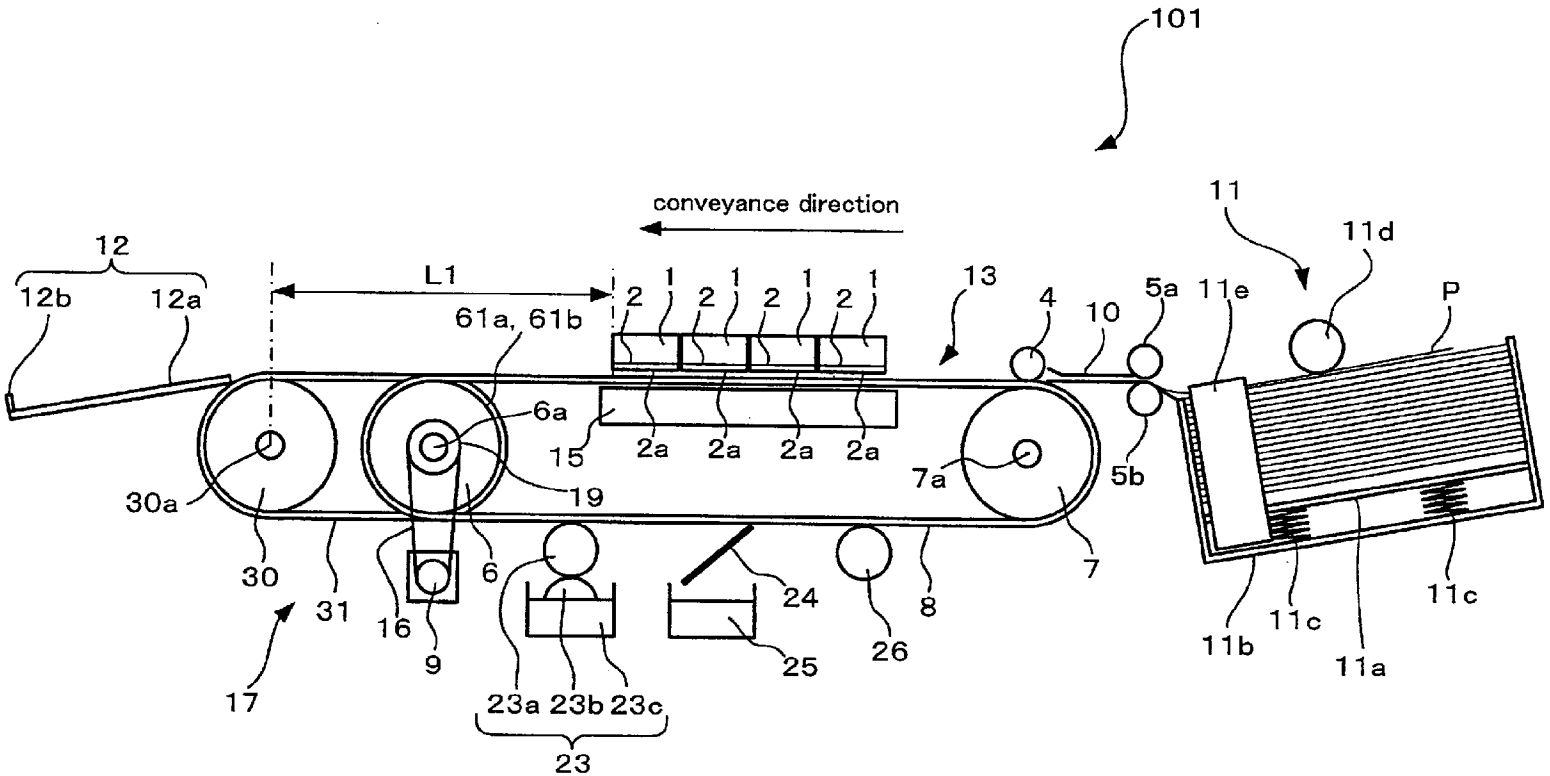
FIG. 1 is a schematic side view showing a general structure of an ink-jet printer according to a first embodiment of the present invention.
Figure 2:
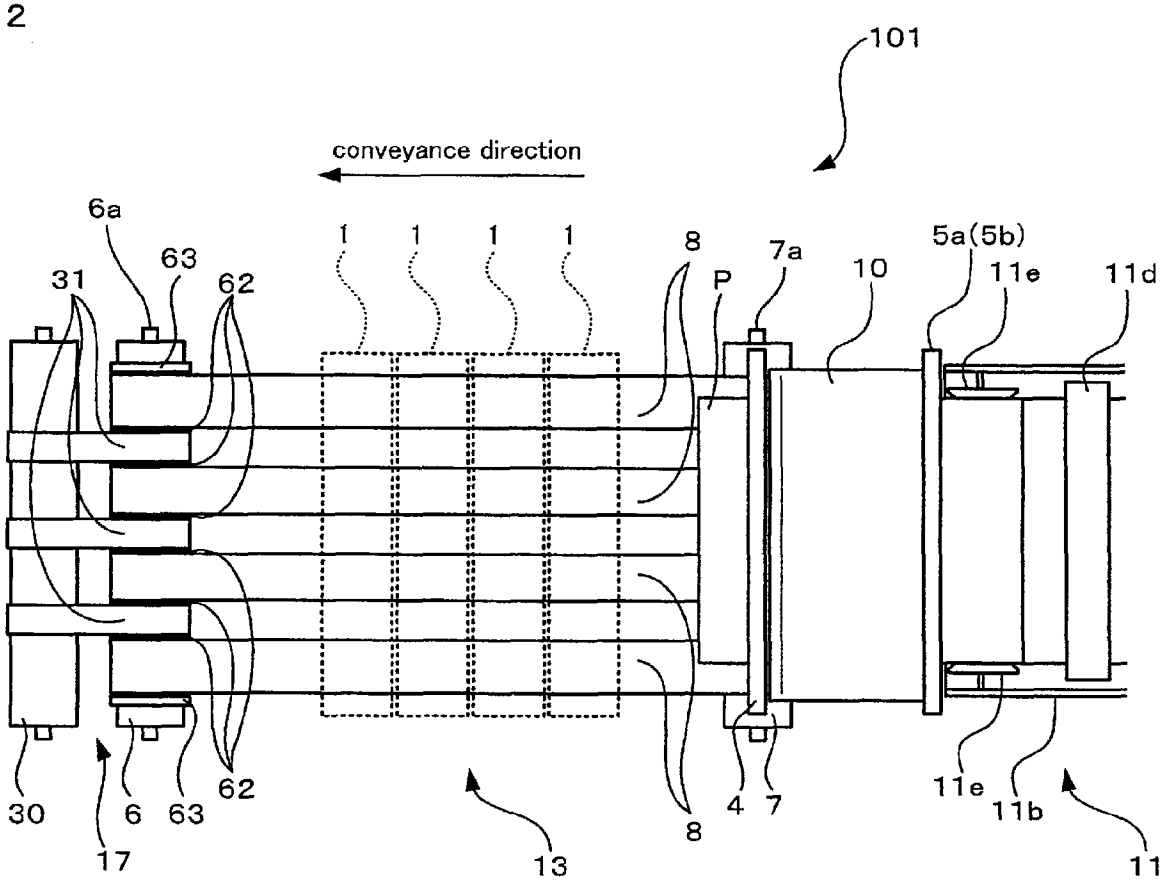
FIG. 2 is a plan view of the ink-jet printer.

An ink-jet printer 101 according to a first embodiment of an image recording apparatus of the present invention includes a paper feed unit 11, a conveyance unit 13, four ink-jet heads 1, a separation unit 17, and a paper discharge tray 12, as shown in FIGS. 1 and 2. The paper feed unit 11 feeds a paper P which is a recording medium to the conveyance unit 13. The conveyance unit 13 conveys the paper P which has been fed by the paper feed unit 11, while supporting the paper P on outer surfaces of four conveyor belts 8. The ink-jet heads 1 print an image by ejecting ink droplets to a surface, that is, a printing surface, of the paper P which is being conveyed by the conveyance unit 13. The separation unit 17 receives a printed paper P from the conveyor belts 8, and at the same time separates the printed paper P from the conveyor belt 8. In addition, the separation unit 17 conveys the printed paper P to the paper discharge tray 12. The paper discharge tray 12 receives the paper P which has been conveyed by the separation unit 17. The paper P has a rectangular shape, and a size defined by a standard, such as the A4 size, the B5 size, the postcard size, and the like.

A paper conveyance path through which the paper P is conveyed in a conveyance direction from the paper feed unit 11 toward the paper discharge tray 12 (i.e., a direction from right to left in FIGS. 1 and 2) is formed within the ink-jet printer 101. A controller (not shown) controls operations of respective parts of the ink-jet printer 101.

As shown in FIG. 1, each of the ink-jet heads 1 has a head main body 2 at its lower part. A bottom face of the head main body 2 is an ejection face 2*a* in which formed are ejection openings for ejecting ink droplets. Yellow ink droplets, cyan ink droplets, magenta ink droplets, and black ink droplets are ejected respectively from ejection faces 2*a* of the head main bodies 2 of the four ink-jet heads 1. The head main body 2 has an elongated rectangular parallelepiped shape. The ink-jet heads 1 are fixed at predetermined intervals with respect to the conveyance direction, in such a manner that a lengthwise direction of the head main bodies 2 extends in parallel with a direction perpendicular to the conveyance direction, that is, in parallel with shafts 6*a* and 7*a* of the belt rollers 6 and 7. Thus, the ink-jet printer 101 is a line-type color ink-jet printer.

The paper feed unit 11 includes a paper tray 11*a*, a paper storage box 11*b*, coiled springs 11*c*, a pick-up roller 11*d*, and a pair of positioning plates 11*e*. The paper tray 11*a* is disposed within the paper storage box 11*b*, and papers P are stacked on an upper face of the paper tray 11*a*. The paper storage box 11*b* is opened at a top thereof, and stores therein papers P which are stacked on the paper tray 11*a*. The coiled springs 11*c* are disposed between a bottom face of the paper storage box 11*b* and the paper tray 11*a*, and bias the paper tray 11*a* upward. Due to elastic force of the coiled springs 11*c*, the pick-up roller 11*d* is always in contact with an uppermost one of papers P stored in the paper storage box 11*b*. A length of each positioning plate 11*e* with respect to a paper stacking direction is substantially the same as that of the paper storage box 11*b*. Each positioning plate 11*e* is disposed at a position near a downstream side wall of the paper storage box 11*b* with respect to the conveyance direction and slightly spaced away from the downstream side wall toward inside. An inner surface of each positioning plate 11*e* is in contact with sides of the papers P, which are stored in the paper storage box 11*b*, extending along the conveyance direction. The pair of positioning plates lie set a position of the papers P so as to make respective sides of the papers P placed on different conveyor belts 8.

Under control by a controller (not shown), the pick-up roller 11*d* feeds out the uppermost paper P from the paper feed unit 11 at a predetermined timing, in association with a separation mechanism (not shown) which prevents multi-feeding of the papers P. The paper P is pinched between a pair of rollers 5*a* and 5*b* which are disposed between the paper feed perpendicular to the paper P. The adhesive layer is formed by subjecting a rubber material such as an ethylene propylene rubber (EDPM) to a surface treatment using an urethane material, silicone, or the like and then providing unevenness and pores on a surface of the rubber material. As shown in FIG. 2, the conveyor belts 8 extend in parallel to each other and at regular intervals with respect to a direction of the shafts 6*a* and 7*a* of the belt rollers 6 and 7.

As shown in FIG. 1, a nip roller 4 is disposed on the belt roller 7 with interposition of the conveyor belts 8. The nip roller 4 presses the paper P, which has been fed out by the pair of rollers 5*a* and 5*b*, onto the outer surfaces of the conveyor belts 8.

When the motor 9 is driven to rotate its output shaft, an endless transmission belt 16 travels. The transmission belt 16 is wound around the output shaft and a transmission roller 19 which is fixed to the shaft 6*a* of the belt roller 6, so as to be stretched between them. Therefore, when the output shaft of the motor 9 is rotated in the counterclockwise direction in FIG. 1, the shaft 6*a* of the belt roller 6 is rotated in the counterclockwise direction in unit 11 and the conveyance unit 13, and in this condition passes through a pair of guide plates 10, to reach the conveyance unit 13. Here, the pair of rollers 5*a* and 5*b* may function as the separation mechanism. In such a case, the roller 5*a* rotates in a direction for conveying the paper P toward the ink-jet heads 1, that is, in a clockwise direction in FIG. 1, while the roller 5*b* rotates in a direction for conveying the paper P toward the paper feed unit 11, that is, in a counterclockwise direction in FIG. 1.

The conveyance unit 13 includes two belt rollers 6 and 7, four endless conveyor belts 8, a platen 15, and a motor 9. The two belt rollers 6 and 7 have rotation shafts 6*a* and 7*a* which are parallel to each other. The four conveyor belts 8 are wound around the respective rollers 6 and 7 to be stretched between them.

The belt rollers 6 and 7 are disposed so as to sandwich the four ink-jet heads 1 therebetween with respect to the conveyance direction. The outer surface of the conveyor belt 8, which is formed of an adhesive layer, has adsorptivity toward the paper P. The gravity and the adsorptivity act on the paper P existing on the belt, in a direction FIG. 1 along with traveling of the transmission belt 16. Then, along with rotation of the belt roller 6, the conveyor belts 8 travel and the belt roller 7 is rotated in the counterclockwise direction in FIG. 1. The paper P, which has been pressed onto the outer surfaces of the conveyor belts 8 by the nip roller 4, is conveyed while being supported on outer surfaces of upper loops of the conveyor belts 8.

The platen 15 is disposed in a region enclosed by the conveyor belts 8 in such a manner that an upper face of the platen 15 is opposed to the ejection faces 2*a* of the ink-jet heads 1. The upper face of the platen 15 supports the conveyor belts 8 in order to prevent parts of the conveyor belts 8 opposed to the ejection faces 2*a* from bending downward.

When the paper P being conveyed by the conveyor belts 8 are passing just under the four head main bodies 2, ink of respective colors is selectively ejected from the ejection faces 2*a* of the respective head main bodies 2 toward a surface, that is, a printing surface, of the paper P in accordance with an image to be printed, so that a desired color image is formed on the printing surface of the paper P.

The separation unit 17 includes a separation roller 30 and three endless separation belts 31. The separation roller 30 has a rotation shaft 30*a* which is parallel to the rotation shafts 6*a* and 7*a* of the belt rollers 6 and 7. The three separation belts 31 are wound around the separation roller 30 and the belt roller 6 so as to be stretched between them.

The separation roller 30 is located on a downstream of the belt roller 6 with respect to the conveyance direction. As shown in FIG. 2, the separation belts 31 are disposed in parallel with each other and at regular intervals with respect to a direction of the shaft 30*a* of the separation roller 30. Outer surfaces of the separation belts 31 have adsorptivity which is lower than the adsorptivity of the outer surfaces of the conveyor belts 8. More specifically, the adsorptivity of the outer surfaces of the separation belts 31 is at such a level that the paper P is easily separated using no special member. The adsorptivity of the separation belts 31 may be zero.

On the belt roller 6, as shown in FIG. 2, the conveyor belts 8 and the separation belts 31 are disposed alternately with respect to the direction of the shaft 6*a*. The conveyor belts 8 are disposed at both end portions on the belt roller 6 with respect to the direction of the shaft 6*a*.

As shown in FIG. 1, the belt roller 6, the belt roller 7, and the separation roller 30 have the same radius, and the shafts 6*a*, 7*a*, and 30*a* are at the same level. Therefore, the belt rollers 6 and 7, and the separation roller 30 have a common tangent plane. The tangent plane corresponds to upper loops of the conveyor belts 8 and the separation belts 31. The paper P is conveyed along the tangent plane.

When the motor 9 is driven to rotate the belt roller 6 in the counterclockwise direction in FIG. 1, the separation belts 31 travel and accordingly the separation roller 30 is rotated in the counterclockwise direction in FIG. 1. The paper P, which has been conveyed while being supported on the outer surfaces of the conveyor belts 8, moves onto the outer surfaces of the separation belts 31 and is separated from the outer surfaces of the conveyor belts 8 sequentially from a leading edge thereof. The paper P thus having moved from the conveyor belts 8 to the separation belts 31 is, while supported on the outer surfaces of the upper loops of the separation belts 31, conveyed from the belt roller 6 toward the separation roller 30 into the paper discharge tray 12.

Figure 3:
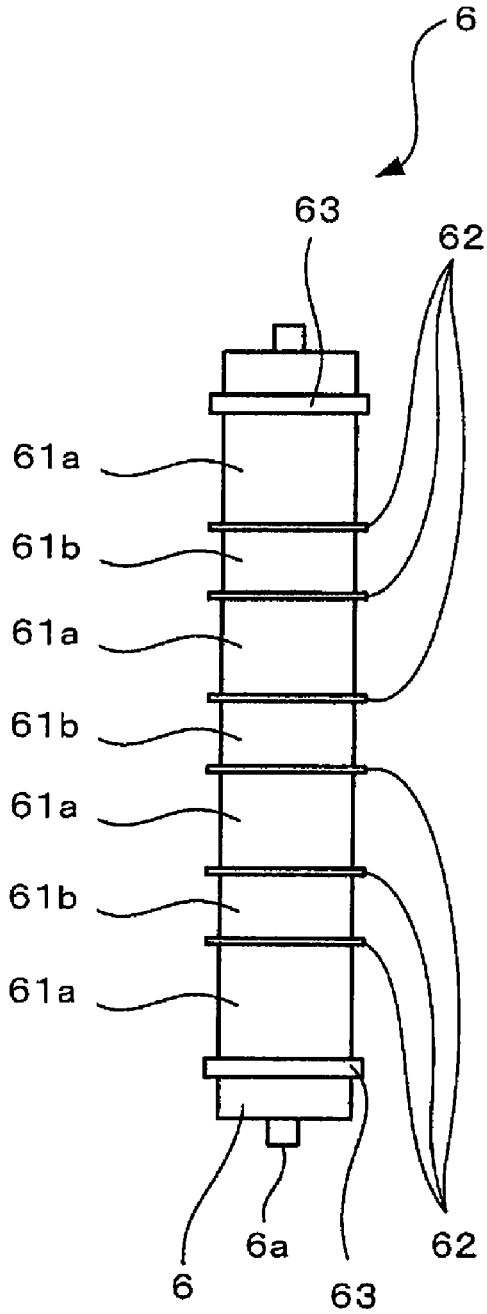
FIG. 3 is a plan view of a belt roller which is a part of the ink-jet printer.

As shown in FIGS. 2 and 3, a pair of protrusions 63 which function as a belt stopper are annularly formed on a circumferential surface of the belt roller 6, near both ends of the belt roller 6 with respect to the direction of the shaft 6*a*. In addition, in a region between the pair of protrusions 63, six partitions 62 are annularly formed at regular intervals with respect to the direction of the shaft 6*a*. The six partitions 62 partition the conveyor belts 8 and the separation belts 31 from each other. As shown in FIG. 3, regions 61*a* where the conveyor belts 8 are disposed and regions 61*b* where the separation belts 31 are disposed are alternately formed on the circumferential surface of the belt roller 6 with respect to the direction of the shaft 6*a*. The partitions 62 function as boundaries between the regions 61*a* and the regions 61*b*. With respect to the direction of the shaft 6*a*, a length of the region 61*a* is the same as that of the conveyor belt 8, and a length of the region 61*b* is the same as that of the separation belt 31. At each end of the belt roller 6 with respect to the direction of the shaft 6*a*, the region 61*a* where the conveyor belt 8 is disposed is formed between the protrusion 63 and the partition 62.

The protrusion 63 and the partition 62 may be formed on the belt roller 6 either by integral molding or by press-fitting a ring with a cylindrical roller 6.

A protruding amount of the protrusions 63 and the partitions 62 from the circumferential surface of the belt roller 6, and a thickness of the conveyor belts 8 and the separation belts 31 are the same. As a result, distal ends of the protrusions 63, distal ends of the partitions 62, and outer surfaces of the conveyor belts 8 and the separation belts 31, which are wound around the belt roller 6, are all at the same level.

The conveyor belts 8 and the separation belts 31 are wound around the belt roller 6 in such a manner that inner surfaces thereof are in contact with the regions 61*a* and the regions 61*b* of the belt roller 6, respectively. As shown in FIG. 2, with respect to the direction of the shaft 6*a*, neighboring conveyor belts 8 are spaced from each other at an interval equivalent to a width of the separation belt 31 plus widths of two partitions 62. In addition, with respect to the direction of the shaft 6*a*, neighboring separation belts 31 are spaced from each other at an interval equivalent to a width of the conveyor belt 8 plus widths of two partitions 62. That is, each of the conveyor belts 8 and the separation belts 31 is sandwiched between the protrusion 63 and the partition 62 or between two partitions 62, without any space formed.

The conveyor belts 8 are able to convey papers P having different lengths in the conveyance direction, such as A4 size papers P, B5 size papers P, postcard size papers P, and the like. As shown in FIG. 1, a distance L1 between the rotation shaft 30*a* of the separation roller 30 and a downstream end of the most downstream one of the heads 1 with respect to the conveyance direction is equal to or longer than a side of, among the papers P which can be conveyed by the conveyor belts 8, a paper P having the longest side in the conveyance direction. Both sides of the maximum size paper P are positioned by the pair of positioning plates 11*e* so as to locate on two conveyor belts 8 disposed at both ends of the belt roller 6 with respect to the direction of the shaft 6*a*.

The paper discharge tray 12 is disposed at a position opposite to the belt roller 6 across the separation roller 30, that is, on a downstream of the separation roller 30 with respect to the conveyance direction. The paper discharge tray 12 has a rectangular plate 12*a* and a stopper 12*b* which protrudes upward from a downstream end portion of the rectangular plate 12*a* with respect to the conveyance direction. An upstream end portion of the rectangular plate 12*a* with respect to the conveyance direction is disposed adjacent to the separation belt 31 located on the separation roller 30. The rectangular plate 12*a* slopes down toward a downstream in the conveyance direction to a level lower than the tangent plane of the belt rollers 6, 7 and the separation roller 30, that is, lower than a plane for conveying the paper P on the conveyor belts 8 and the separation belts 31. The paper P, which has been conveyed while supported on the outer surfaces of the separation belts 31, moves onto the rectangular plate 12*a* sequentially from a leading edge thereof, goes down along a slope of the rectangular plate 12*a*, and stops when the leading edge comes into contact with the stopper 12*b*. In this way, the paper P is received into the paper discharge tray 12.

Below the conveyor belts 8, a washing unit 23, a blade 24, and a wiping roller 26 are disposed in this order from the belt roller 6 toward the belt roller 7. They perform a cleaning operation for removing foreign materials such as paper dust, contamination, and the like, from the outer surfaces of the conveyor belts 8. The washing unit 23 has a washing roller 23*a*, a supply roller 23*b*, and a washing liquid tank 23*c*. The washing roller 23*a* is in contact with the outer surfaces of the four conveyor belts 8. The supply roller 23*b* is in contact with an outer surface of the washing roller 23*a* to clean the outer surface of the washing roller 23*a*, and supplies washing liquid to the washing roller 23*a*. The washing liquid tank 23*c* stores washing liquid therein. The blade 24 is a plate member made of an elastic material such as a rubber. A distal end of the blade 24 is in contact with the outer surfaces of the four conveyor belts 8. The blade 24 is inclined downward in a direction opposite to a direction of traveling of the conveyor belt 8 in a lower loop, that is, inclined in a direction from the belt roller 7 toward the belt roller 6. A waste liquid tank 25 is placed below the blade 24. The wiping roller 26 is made of a hygroscopic material, and in contact with the outer surfaces of the conveyor belts 8.

Along with traveling of the conveyor belts 8, the washing roller 23*a* is rotated in the clockwise direction in FIG. 1 and the supply roller 23*b* is rotated in the counterclockwise direction in FIG. 1. At this time, washing liquid stored in the washing liquid tank 23*c* is applied to the outer surfaces of the conveyor belts 8 through the supply roller 23*b* and the washing roller 23*a*. The washing liquid is, together with foreign materials adhering to the outer surfaces of the conveyor belts 8, scraped off by the blade 24. The washing liquid including foreign materials, which has been scraped off by the wiper 24, flows along an upper face of the blade 24 and falls down into the waste liquid tank 25. Further, on a downstream of the blade 24 with respect to the direction of traveling of the conveyor belt 8 in the lower loop, the wiping roller 26 which is in contact with the outer surfaces of the conveyor belts 8 is rotated in the clockwise direction in FIG. 1 along with traveling of the conveyor belts 8, to thereby remove washing liquid left on the outer surfaces, that is washing liquid which has not been removed by the blade 24. In this way, the outer surfaces of the conveyor belts 8 are cleaned.

As thus far described above, in this embodiment, the paper P which has been conveyed while being supported on the outer surfaces of the conveyor belts 8 moves onto the outer surfaces of the separation belts 31, so that the paper P is surely separated from the outer surfaces of the conveyor belts 8. The separation belts 31 serve not only to separate the paper P from the conveyor belts 8 but also to convey the paper P further to the paper discharge tray 12. Thus, the paper P separated from the conveyor belts 8 is conveyed to the paper discharge tray 12 not by a pair of rollers or the like but by the separation belts 31. Therefore, it is not necessary to provide a pair of rollers. As a result, problems involved in a pair of rollers, such as damage to a printing surface of the paper P, jamming, and the like, can be avoided. In addition, since adsorptivity of the outer surfaces of the separation belts 31 is lower than that of the outer surfaces of the conveyor belts 8, it is easy for the paper P to be separated from the outer surfaces of the separation belts 31.

If, for example, the separation roller 30 is disposed lower than its position shown in FIG. 1, a paper conveyance path extending from the belt roller 7 to the separation roller 30 is not on the same straight line. In such a case, when a paper P moves from the conveyor belts 8 to the separation belts 31, the paper P bends and its rear end portion rises up from the conveyor belts 8, which may cause deterioration in printing quality. Moreover, a rear end of the paper P may come into contact with the ejection face 2*a*, to damage the ejection face 2*a*. In this embodiment, however, the belt rollers 6, 7 and the separation roller 30 have the common tangent plane, and the paper P is conveyed on the same straight line along the tangent plane. Therefore, the above-mentioned problems can be reduced.

The rectangular plate 12*a* of the paper discharge tray 12 slopes down toward the downstream in the conveyance direction to the level lower than the tangent plane. This ensures that the paper P conveyed by the separation belts 31 is received by the paper discharge tray 12.

The conveyor belts 8 are able to convey papers P having different lengths in the conveyance direction and, as shown in FIG. 1, the distance L1 is longer than a side of, among the papers P which can be conveyed by the conveyor belts 8, a paper P having the longest side in the conveyance direction. Accordingly, a paper P of every conveyable size is supported on the conveyor belts 8 and the separation belts 31 until printing is completed, that is, until a rear end of the paper P passes over an area under the leftmost head 1 in FIG. 1. That is, it does not occur that a leading end of the paper P moves from the separation belts 31 to the paper discharge tray 12 during printing, and particularly during printing performed on a rear end portion of the paper P. This can prevent the paper P from bending, rising up from the conveyor belts 8, and the like. Therefore, deterioration in printing quality and damage to the ejection face 2*a* which may be caused by contact with the paper P can be suppressed.

As shown in FIGS. 2 and 3, the partitions 62 are formed on the circumferential surface of the belt roller 6. This can prevent the conveyor belts 8 and the separation belts 31 from being misaligned with respect to the direction of the shaft 6*a* and interfering with each other.

If, on the belt roller 6, the outer surfaces of the separation belts 31 and/or the distal ends of the partitions 62 are at a position higher than the outer surfaces of the conveyor belts 8 for example, a leading end of the paper P, which has been conveyed while being supported on the outer surfaces of the conveyor belts 8, may come into contact with the separation belts 31 and/or the partitions 62, to hinder smooth conveyance of the paper p. In this embodiment, however, on the belt roller 6, the outer surfaces of the conveyor belts 8, the outer surfaces of the separation belts 31, and the distal ends of the partitions 62 are at the same level. Therefore, the above-mentioned problem can be reduced, and smooth conveyance of the paper P can be realized.

On the belt roller 6, the conveyor belts 8 and the separation belts 31 are disposed alternately with respect to the direction of the shaft 6*a*. As a result, conveyance force and separation force, which are even with respect to a widthwise direction of the paper P, acts on the paper P. This enables the paper P to be conveyed stably along the conveyance direction without being inclined obliquely.

The conveyor belts 8 are disposed at the both ends on the belt roller 6 with respect to the direction of the shaft 6*a*, and both sides of the paper P extending in the conveyance direction are supported to the respective conveyor belts 8. In this way, the paper P can be prevented from rising up in its portions near the sides. Thus, good printing can be realized. On the other hand, if the separation belts 31 are disposed at the both ends on the belt roller 6 with respect to the direction of the shaft 6*a*, both sides of the paper P are supported on the separation belts 31. This causes a problem that portions of the paper P near the size may rise up. In such a case, it is conceivable that the sides of the paper P are supported on the conveyor belts 8 which are inside adjacent to the separation belts 31, for the purpose of avoiding the above problem. However, this involves a waste use of space, and a size of the ink-jet printer 101 increases with respect to the direction of the shaft 6*a*. Such increase in size can also be suppressed in this embodiment.

The ink-jet printer 101 has the positioning plates 11*e* which set a position of the paper P so as to make sides of the papers P extending in the conveyance direction placed on different conveyor belts 8. As a result, the sides of the paper P can be surely supported on the conveyor belts 8. Thus, rising of portion of the paper P near the sides as mentioned above can be avoided.

The belt roller 6, which is one of the two belt rollers 6 and 7 disposed downstream in the conveyance direction, is a drive roller. Accordingly, stable tension is applied to the upper loops of the conveyor belts 8, that is, parts of the conveyor belts 8 on which the paper P is supported. Therefore, bending of the conveyor belts 8 in those parts can be suppressed. In addition, since the conveyor belts 8 and the separation belts 31 are wound around the roller 6, both of the conveyor belts 8 and the separation belts 31 can be simultaneously driven by the single motor 9. This simplifies a structure and realizes downsizing and lower costs of the ink-jet printer 101, as compared with when the conveyor belts 8 and the separation belts 31 are driven by different drive sources. Further, a traveling speed of the conveyor belts 8 and a traveling speed of the separation belts 31 becomes the same. Therefore, the paper P can be conveyed in a good manner when moving from the conveyor belts 8 to the separation belts 31.

In this embodiment, adsorptivity is provided by a simple structure of forming the adhesive layer on the outer surfaces of the conveyor belts 8.

The ink-jet printer 101 has the members 23, 24, and 26 which clean the outer surfaces of the conveyor belts 8. Therefore, a condition of the outer surfaces can be kept well, and the adhesive layer is prevented from decreasing its adhesive force. As a result, the paper P can sustainably be conveyed in a good manner.

In a case where the belt rollers 6, 7 and the separation roller 30 have different radiuses, it may be possible to adjust positions of the shafts 6*a*, 7*a*, and 30*a* of the respective rollers 6, 7, and 30 in such a manner that the rollers 6, 7, and 30 have a common tangent plane. For example, in a case where a radius of the separation roller 30 is smaller than a radius of the belt rollers 6 and 7, positions of the shafts 6*a*, 7*a*, and 30*a* of the respective rollers 6, 7, and 30 may be adjusted in such a manner that the rollers 6, 7, and 30 have a common tangent plane. In such a case, even when the outer surfaces of the separation belts 31 have some adsorptivity, the paper P conveyed by the separation belts 31 are surely separated from the separation belts 31 in the vicinity of the separation roller 30, because a portion of the separation belts 31 wound around the separation roller 30 has a relative large curvature.

Although the rectangular plate 12*a* of the paper discharge tray 12 slopes toward the downstream in the conveyance direction, this is not limitative. For example, it may be possible that the rectangular plate 12*a* does not slope but extends horizontally at a position lower than the tangent plane. In order to downsize the ink-jet printer 101, the paper discharge tray 12 may be omitted.

On the belt roller 6, the outer surfaces of the conveyor belts 8 may locate higher than the distal ends of the partitions 62. In addition, on the belt roller 6, the outer surfaces of the separation belts 31 may locate lower than the outer surfaces of the conveyor belts 8. In such cases as well, the above-mentioned problem of hindrance of smooth conveyance of the paper P can be reduced.

The partitions 62 and/or the protrusions 63 may be omitted.

The belt roller 7 which is one of the two belt rollers 6 and 7 disposed upstream in the conveyance direction may be a drive roller.

In the first embodiment, the adhesive layer is adopted for adsorptivity of the conveyor belts 8 toward the paper P. However, this is not limitative. For example, adsorptivity may be generated in ways of electrification, air suction, and the like In a modification shown in FIG. 4, adsorptivity is realized by electrification. In this modification, conveyor belts 208 are made of a high polymer material having high insulation resistance, such as a polycarbonate. The conveyor belts 208 have high electrification properties. An electrification roller 21 is disposed on a left of the belt roller 7. The electrification roller 21 is in contact with inner surfaces of the conveyor belts 208 in their upper loops. When the conveyor belts 208 travel, the conveyor belts 208 and the electrification roller 21 are rubbed against each other, so that the conveyor belts 208 are electrified. Thus, outer surfaces of the conveyor belts 208 adsorb the paper P due to electrostatic force. In this modification, adsorptivity can be adjusted in accordance with intensity of the electrostatic force. A diselectrification device 22 is disposed on a right of the belt roller 6. The diselectrification device 22 is opposed to outer surfaces of the conveyor belts 208 in their lower loops. The diselectrification device 22 includes a diselectrification blower and the like. The diselectrification device 22 is driven by a controller (not shown) in the above-mentioned cleaning operation, and diselectrifies the conveyor belts 208. Thereby, electrostatic force is removed from the outer surfaces of the conveyor belts 208 which therefore obtain non-adsorptivity. By performing the cleaning operation in this condition that electrostatic force has been removed from the outer surfaces of the conveyor belts 208, foreign materials adhering to the outer surfaces can be easily and surely removed.

Figure 5:
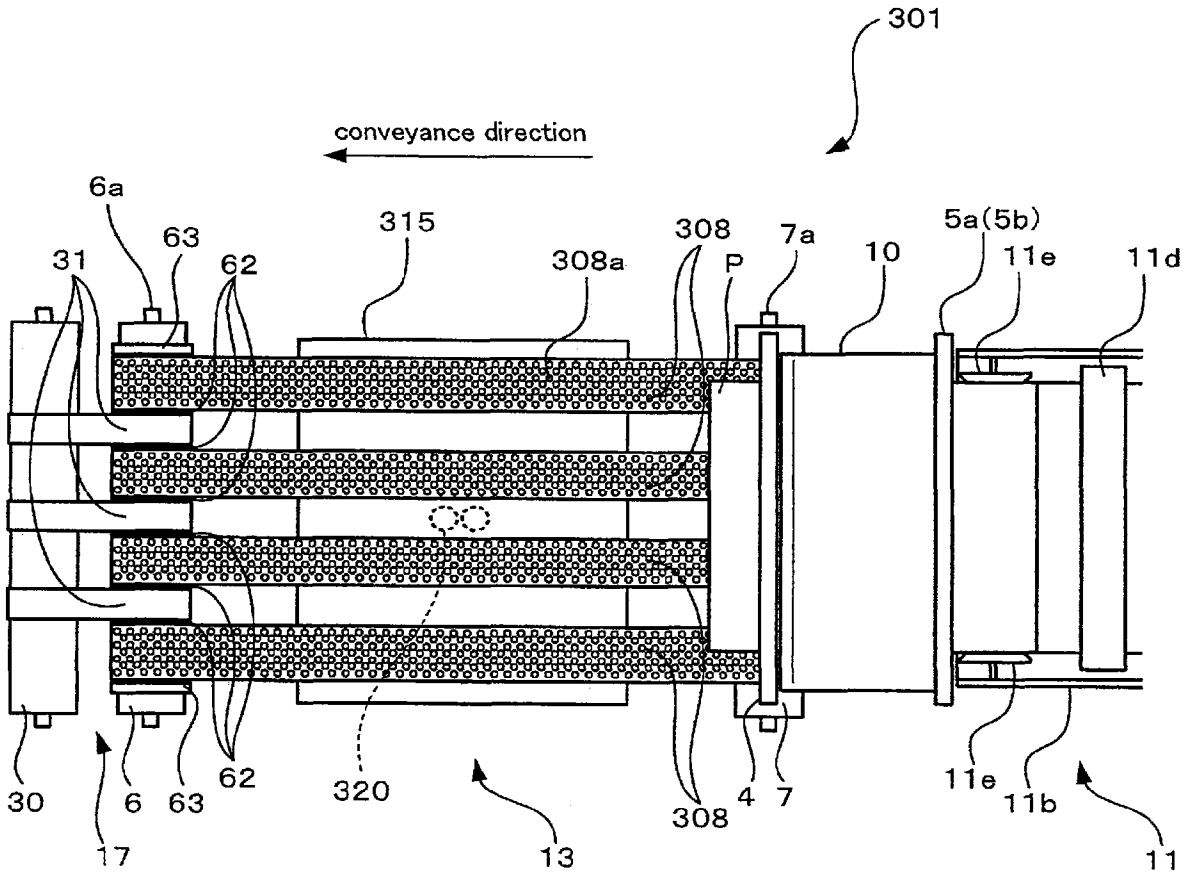
FIG. 5 is a plan view of an ink-jet printer according to another modification.

In the modification shown in FIG. 5, adsorptivity is realized by air suction. In this modification, conveyor belts 308 have through holes 308*a*. A suction device 320 is disposed within a platen 315. The suction device 320 generates an air stream which flows from outer surfaces toward inner surfaces of the conveyor belts 308 through the through holes 308*a*. When the suction device 320 is driven by a controller (not shown), adsorptivity occurs on the outer surfaces of the conveyor belts 308, so that the paper P adsorbs onto the outer surfaces. In this modification, adsorptivity can be adjusted in accordance with strength of the air stream.

Figure 6:
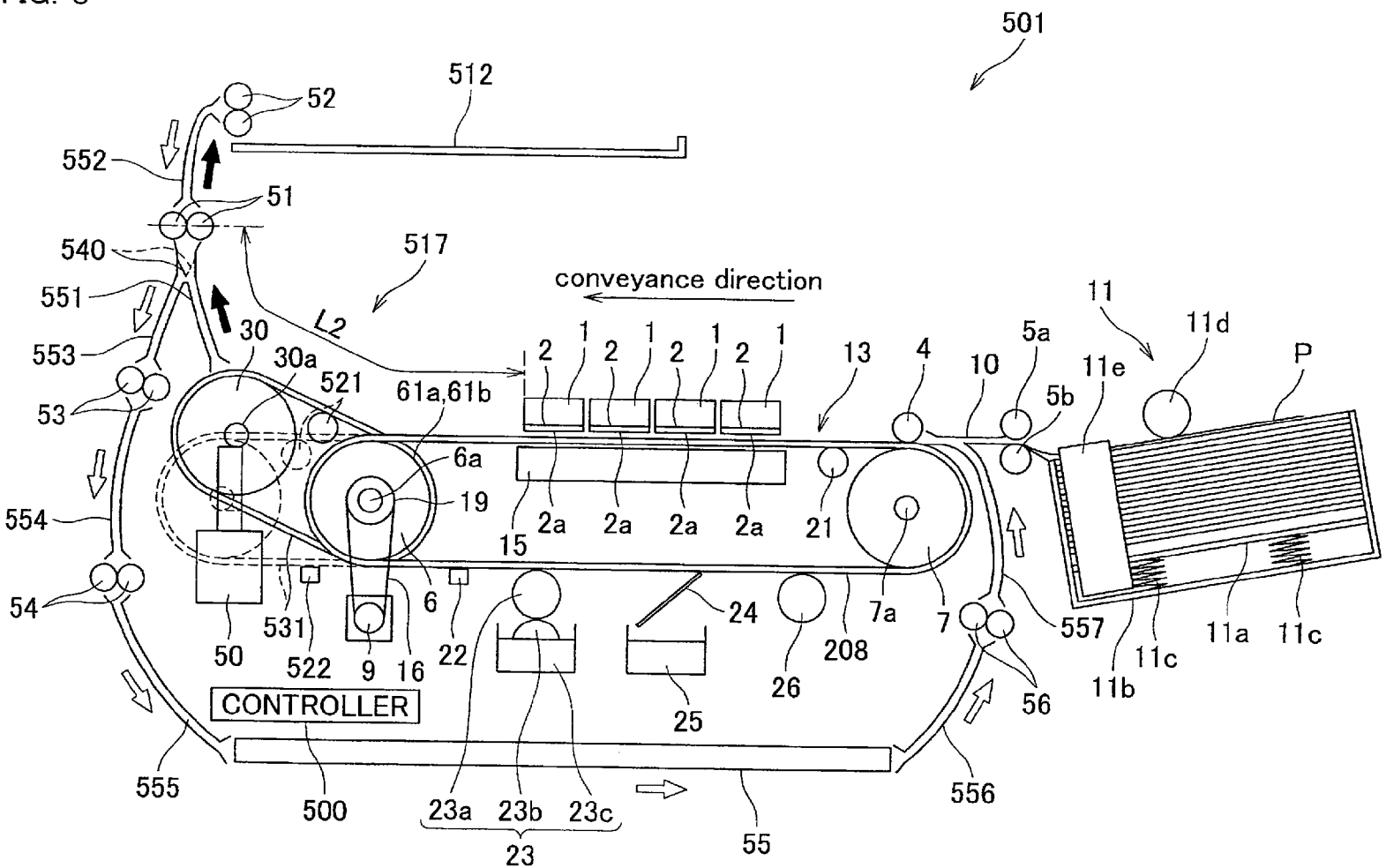
FIG. 6 is a schematic side view showing a general structure of an ink-jet printer according to a second embodiment of the present invention.

Next, a second embodiment of the image recording apparatus of the present invention will be described with reference to FIG. 6. An ink-jet printer 501 of this embodiment differs from the modification shown in FIG. 4, in terms of a structure of a separation unit 517, increase in the number of conveyance paths for the papers P, and the paper discharge tray 12 being attachable to and detachable from a housing of the ink-jet printer 501. The same members as described above will be denoted by the same reference numerals, without specific descriptions thereof.

The separation unit 517 has a solenoid 50 which moves a separation roller 30. The separation roller 30 has its rotation shaft 30*a* supported on a movable part of the solenoid 50. Along with up-and-down movements of the movable part which are implemented under control by a controller 500, the separation roller 30 moves in an arc around the shaft 6*a* and selectively takes a first position and a second position as illustrated with broken lines and solid lines in FIG. 6, respectively.

Figure 4:
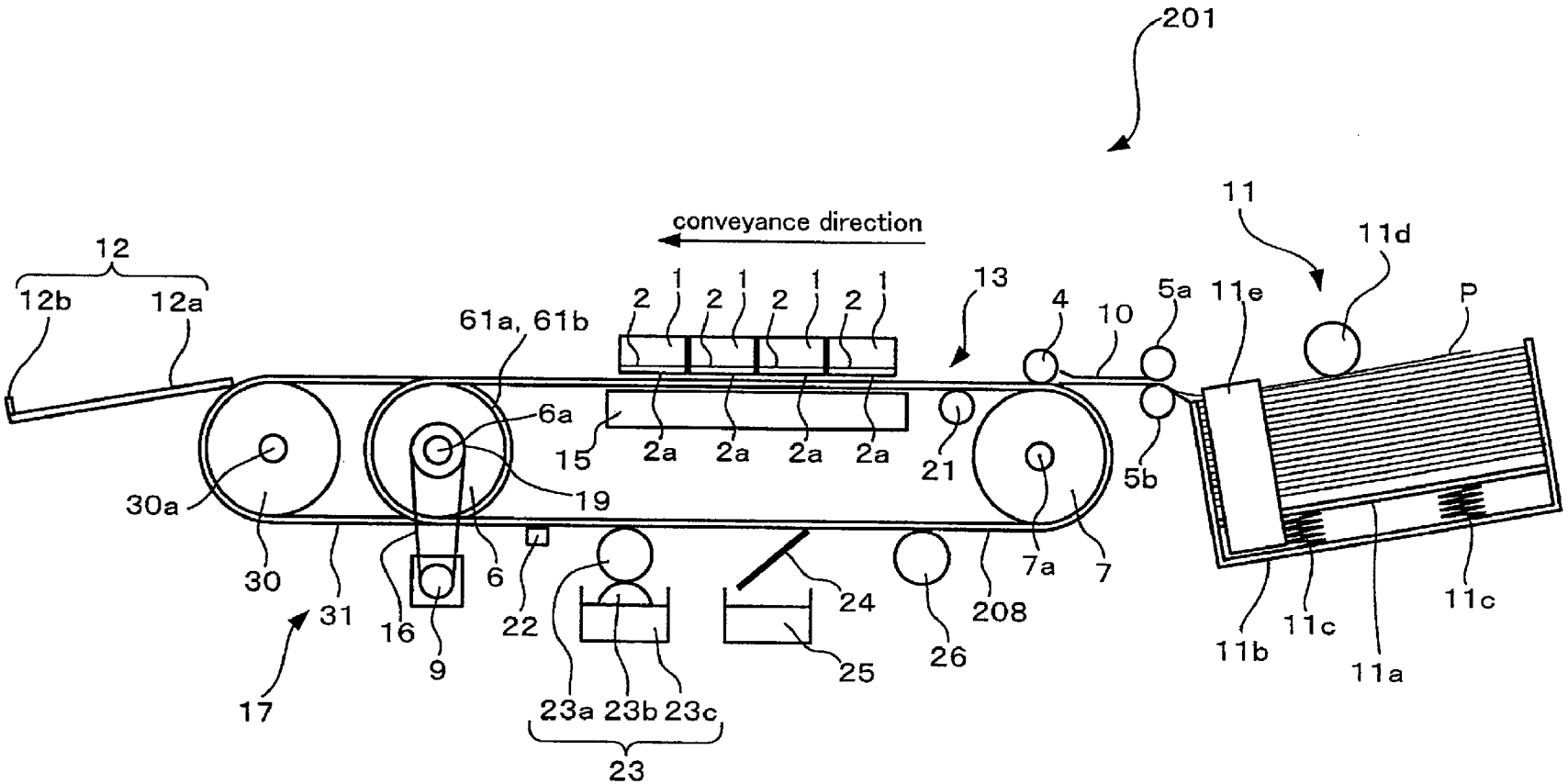
FIG. 4 is a schematic side view showing a general structure of an ink-jet printer according to a modification.

The ink-jet printer 501 has not only a first conveyance path which is the same as shown in FIG. 4, that is, a path extending from the paper feed unit 11 to the paper discharge tray 12 on the same straight line along a horizontal direction in FIG. 4, but also second and third conveyance paths. When the separation roller 30 is in the first position, the paper P is conveyed along the first conveyance path, while when the separation roller 30 is in the second position, the paper P is conveyed along the second or third conveyance path.

In this embodiment, any of the first, second, and third conveyance paths is selected in accordance with whether double-side printing or single-side printing and in accordance with a thickness of the paper P. For example, for performing single-side printing on a paper P having a thickness larger than a predetermined thickness, the first conveyance path is selected. For performing single-side printing on a paper P having a thickness not larger than the predetermined thickness, the second conveyance path is selected. For performing double-side printing on a paper P having a thickness not larger than the predetermined thickness, the third conveyance path is selected. Here, double-side printing on a paper P having a thickness larger than the predetermined thickness is not allowed.

The second conveyance path extends on the same straight line from the paper feed unit 11 to the conveyance unit 13. Then, at the separation unit 17, the second conveyance path extends obliquely upward along separation belts 531, and further extends upward as indicated by thick and black arrows in FIG. 6 toward a paper discharge unit 512 which is provided on an upper face of the ink-jet printer 501. The third conveyance path firstly extends in the same manner as the second conveyance path does, until it reaches a pair of double-feeding rollers 52 which are provided near the paper discharge unit 512. From the pair of double-feeding rollers 52, the third conveyance path extends downward along white arrows, passes through a double-side conveyance unit 55 which is provided below the conveyance unit 13, passes through between the guide plates 10 again to reach the conveyance unit 13, and then extends toward the paper discharge unit 512 in the same manner as the second conveyance path does.

Like the conveyor belts 208, the separation belts 531 of this embodiment are made of a high polymer material having high insulation resistance, such as a polycarbonate, and have high electrification properties. An electrification roller 521 is disposed between the belt roller 6 and the separation roller 30. The electrification roller 521 is in contact with inner surfaces of the separation belts 531 in their upper loops. The electrification roller 521 moves together with the separation roller 30 while always being in contact with the inner surfaces of the separation belts 531 in their upper loops. A diselectrification device 522 is disposed in such a manner that, when the separation roller 30 is in the first position, the diselectrification device 522 is opposed to outer surfaces of lower loops of the separation belts 531 in a space between the belt roller 6 and the separation roller 30.

The controller 500 controls the electrification roller 521 and the diselectrification device 522 in such a manner that when the separation roller 30 is in the first position the separation belts 531 are diselectrified while when the separation roller 30 is in the second position the separation belts 531 are electrified. That is, when the separation roller 30 is in the first position so that the paper P is conveyed along the first conveyance path, like in the first embodiment, the outer surfaces of the separation belts 531 have adsorptivity which is lower than the adsorptivity of the outer surfaces of the conveyor belts 208. More specifically, the adsorptivity of the outer surfaces of the separation belts 531 is at such a level that the paper P is easily separated using no special member. When the separation roller 30 is in the second position so that the paper P is conveyed along the second or third conveyance path, the outer surfaces of the separation belts 531 have its adsorptivity toward the paper P improved by electrostatic force. The adsorptivity is lower than that of the outer surfaces of the conveyor belts 208, and at such a level that the paper P can be conveyed and separated using no special member.

Here, control performed by the controller 500 will be described. When the controller 500 receives a signal indicating a thickness of the paper P and whether double-side printing or single-side printing should be performed from a PC (personal computer) connected to the ink-jet printer 501 for example, the controller 500 controls respective parts of the printer in accordance with the signal.

When a signal indicating that single-side printing should be performed on a paper P having a thickness not larger than a predetermined thickness is received, the controller 500 controls the solenoid 50 so as to bring the separation roller 30 into the second position. More specifically, in a case where the separation roller 30 is in the first position, the controller 500 extends the movable part of the solenoid 50 upward, and in a case where the separation roller 30 is in the second position, the controller 500 maintains such a state. Further, the controller 500 controls the electrification roller 521 so as to electrify the separation belts 531, and at the same time controls the respective parts of the printer in such a manner that the paper P is printed while being conveyed along the second conveyance path. A switching plate 540 is provided at a junction between guides 551 and 553 below a pair of rollers 51. At this time, the switching plate 540 is controlled by the controller 500 so as to take a position illustrated with a solid line in FIG. 6. The paper P which has moved from the conveyor belts 208 onto the separation belts 531 is conveyed while being supported on the outer surfaces of the separation belts 531 having adsorptivity due to electrostatic force, then further moved obliquely upward while being guided by the guide 551, and then pinched between the pair of rollers 51. Then, by rotation of one of the pair of rollers 51, the paper P is conveyed further upward while being guided by the guide 552. Then, while being pinched between the pair of double-feeding rollers 52, the paper P is discharged to the paper discharge unit 512.

When a signal indicating that double-side printing should be performed on a paper P having a thickness not larger than a predetermined thickness is received, the controller 500 controls the solenoid 50 so as to bring the separation roller 30 into the second position and in addition controls the electrification roller 521 so as to electrify the separation belts 531, in the same manner as described above. The controller 500 also controls the respective parts of the printer in such a manner that the paper P is printed while being conveyed along the third conveyance path. Here, the paper P is conveyed to the pair of double-feeding rollers 52 in the same manner as the above-described second conveyance path is. Until a leading end of the paper P is pinched between the pair of double-feeding rollers 52, the switching plate 540 is controlled by the controller 500 so as to take the position illustrated with the solid line in FIG. 6. Then, under control by the controller 500, the switching plate 540 takes a position illustrated with a broken line in FIG. 6, and one of the pair of double-feeding rollers 52 is rotated in a reverse direction so that a conveyance direction is reversed. Thus, the paper P, which has its leading end pinched between the pair of double-feeding rollers 52, goes down along the white arrows while being guided by guides 552, 553, and 554 and being pinched by pairs of rollers 51, 53, and 54. At this time, the switching plate 540 regulates the paper P so as to make the paper P surely conveyed in a direction along the white arrows, that is, so as to prevent the paper P from being conveyed in a direction along the thick and black arrows. Then, in the double-side conveyance unit 55, the paper P is conveyed while undergoing inclination correction. Then, the paper P is again fed through between the guide plates 10 to the conveyance unit 13, while being guided by guides 556, 557 and being pinched between a pair of rollers 56. At this time, front and back sides of the paper P is inverted, that is, with the back side up. In this condition, the paper P passes under the heads 2, so that printing is performed on a back surface. In this way, printing is performed on both of the front and back surfaces of the paper P. Then, the paper P is again fed from the separation unit 517 upward along the thick and black arrows, and discharged to the paper discharge unit 512.

When a signal indicating that single-side printing should be performed on a paper P having a thickness larger than a predetermined thickness is received, the controller 500 controls the solenoid 50 so as to bring the separation roller 30 into the first position and in addition controls the diselectrification device 522 so as to diselectrify the separation belts 531. Then, the controller 500 gives a user an instruction to attach the paper discharge tray 12 (see FIG. 4). After detecting that the paper discharge tray 12 is attached, the controller 500 controls the respective parts of the printer so as to make the paper P conveyed along the first conveyance path. This conveyance of the paper P is the same as in the first embodiment, and therefore a description thereof is omitted here.

As thus far described above, in this embodiment, the separation roller 30 is moved through the solenoid 50 to switch the conveyance path in accordance with whether double-side printing or single-side printing and in accordance with a thickness of the paper P. When the first conveyance path is selected, the paper P having been conveyed while being supported on the outer surfaces of the conveyor belts 208 moves onto the outer surfaces of the separation belts 531 so that the paper P is surely separated from the outer surfaces of the conveyor belts 208, like in the first embodiment. The separation belts 531 serve not only to separate the paper P from the conveyor belts 208 but also to convey the paper P further to the paper discharge tray 12 (see FIG. 4). Thus, the paper P separated from the conveyor belts 208 is conveyed to the paper discharge tray 12 not by a pair of rollers or the like but by the separation belts 531. Therefore, it is not necessary to provide a pair of rollers. As a result, problems involved in a pair of rollers, such as damage to a printing surface of the paper P, jamming, and the like, can be avoided. In addition, since adsorptivity of the outer surfaces of the separation belts 531 is lower than that of the outer surfaces of the conveyor belts 208, it is easy for the paper P to be separated from the outer surfaces of the separation belts 531.

When the second or third conveyance path is selected, adsorptivity of the outer surfaces of the separation belts 531 is improved by electrostatic force. Thus, the paper P is conveyed upward while being surely supported on the outer surfaces. Then, the paper P is pinched between the pair of rollers 51. Here, since the separation belts 531 having a conveyance function are disposed on a downstream of the conveyor belts 208 with respect to the conveyance direction, it can be prevented that a leading end of the paper P is pinched between the pair of rollers 51 before printing on the paper P is completed, that is, before a rear end of the paper P passes over an area under the leftmost head 1 in FIG. 6. As a result, deterioration in printing quality on the front and/or back surfaces of the paper P can be suppressed.

Printing on a paper P having a relatively large thickness such as photoprinting often requires higher printing quality as compared with for printing on a paper P having a relatively small thickness such as normal document printing. If the second or third path is selected for single-side printing on a paper P having a thickness larger than a predetermined thickness, printing may not be properly performed particularly on a portion of the paper P including a rear end thereof when a leading end of the paper P is conveyed upward before the printing is completed, so that a portion including the leading end is bent. In this embodiment, therefore, the first conveyance path which is on the same straight line is selected for single-side printing on a paper P having a thickness larger than a predetermined thickness. This can avoid the above-mentioned problem and realize good printing. Thus, this embodiment is suitable for printing requiring a high-quality printing result, such as photoprinting. On the other hand, the second and third conveyance paths are selected respectively for single-side and double-side printing on a paper P having a thickness not larger than a predetermined thickness. Therefore, as described above, deterioration in printing quality on the front and/or back surfaces of the paper P can be suppressed.

When the second or third conveyance path is selected, the separation roller 30 moves in an arc around the shaft 6*a* of the belt roller 6. Therefore, an operation of the separation roller 30 is not complicated, and in addition a moving mechanism for moving the separation roller 30 can be realized by a simple mechanism such as the solenoid 50.

Along the second conveyance path, a distance L2 between a downstream end of the most downstream one of the heads 1 with respect to the conveyance direction and a point at which the pair of rollers 51 pinches the paper P is, like the distance L1 (see FIG. 1), equal to or longer than a side of, among the papers P which can be conveyed by the conveyor belts 8, a paper P having the longest side in the conveyance direction. Accordingly, for a paper P of every size conveyable by the conveyor belts 208, it can be prevented that a leading end of the paper P is pinched between the pair of rollers 51 before printing is completed. Therefore, as described above, deterioration in printing quality on the front and/or back surfaces of the paper P can be suppressed.

Besides, in the second embodiment, the paper discharge tray 12 is attachable and detachable. This can realize downsizing of the ink-jet printer 501.

In the second embodiment, when the second or third conveyance path is selected, adsorptivity of the outer surfaces of the separation belts 531 is improved. This adsorptivity is preferably lower than the adsorptivity occurring on the outer surfaces of the conveyor belts 208. Since there is a print region on the outer surfaces of the conveyor belts 208, it is necessary to improve adsorptivity of the outer surfaces of the conveyor belts 208 to convey the paper P while surely keeping the paper P. However, since the separation belts 531 do not include a print region, adsorptivity thereof need not be improved very much, as long as the separation belts 531 can convey the paper P. Accordingly, even without providing a separation member on a downstream of the separation belts 531 with respect to the conveyance direction, the paper P having conveyed while being supported on the separation belts 531 is naturally separated from the separation belts 531. However, in order to ensure separation, a separation member may be provided on a downstream of the separation belts 531 with respect to the conveyance direction.

In the second embodiment, adsorptivity of the outer surfaces of the separation belts 531 toward the paper P is improved by electrification. However, this is not limitative. For example, it may be improved by air suction or the like. In addition, adsorptivity of the outer surfaces of the separation belts 531 changes depending on the conveyance path. However, it may also be possible that the outer surfaces of the separation belts 531 always have adsorptivity lower than adsorptivity of the outer surfaces of the conveyor belts 208.

In the second embodiment, the pairs of rollers 51 and 52, which are provided on the downstream of the separation belts 531 on the second and third conveyance path, may be omitted.

The predetermined condition is not limited to receiving a signal indicating that single-side printing should be performed on a paper P having a thickness not larger than a predetermined thickness and receiving a signal indicating that double-side printing should be performed on a paper P having a thickness not larger than a predetermined thickness. Various other conditions may be set as the predetermined condition.

The moving mechanism for moving the separation roller 30 is not limited to the solenoid 50. Various other mechanisms may be adopted as the moving mechanism. Moreover, it may not always be necessary that the separation roller 30 moves in an arc around the shaft 6*a* of the belt roller 6.

The number of the conveyor belts 8, 208, 308, and the number of separation belts 31, 531 may be arbitrary value. However, from the standpoint of preventing rising of both sides of the paper P, it is desirable to determine the number of conveyor belts 8, 208, 308 and to set a position by the positioning plates 11*e* in such a manner that when, among papers P conveyable by the conveyor belts 8, 208, 308, a paper P smaller than the maximum size is conveyed, both sides of the paper P extending in the conveyance direction are supported on the conveyor belts 8, 208, 308.

It may be possible that each side of the paper P is placed on a gap which is formed between two neighboring conveyor belts 8, 208, 308. In such a case, in marginless printing, ink droplets ejected to the vicinity of each side of the paper P drop not onto the conveyor belts 8, 208, 308 but onto the platen 15. Therefore, the outer surfaces of the conveyor belts 8, 208, 308 are not contaminated with the ink droplets. In this case, it is advisable to provide a waste ink processor on the platen 15.

It may not be always necessary that the conveyor belts 8, 208, 308 and the separation belts 31, 531 are disposed on the belt roller 6 alternately with respect to the direction of the shaft 6*a*. It may be possible that not the conveyor belts 8, 208, 308 but the separation belts 31, 531 are disposed at the both ends on the belt roller 6 with respect to the direction of the shaft 6*a*.

The image recording apparatus according to the present invention is not limited to a line-type printer, and may be applied to a serial-type printer with a reciprocating head. In addition, it is not limited to an ink-jet type one, and may be applied to a laser-type apparatus. Further, the present invention may be applied not only to printers but also to facsimiles, copying machines, and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a recording head which records an image on a recording medium;

first and second rollers which respectively have rotation shafts parallel to each other;

an endless conveyor belt which is wound around the first and second rollers to be stretched between them, and conveys the recording medium from the first roller to the second roller while supporting the recording medium on an outer surface thereof;

a first adsorber which gives adsorptivity for the recording medium toward the outer surface of the conveyor belt at least in a region thereof opposed to the recording head;

a third roller which has a rotation shaft parallel to the rotation shafts of the first and second rollers, and is disposed at a position opposite to the first roller across the second roller; and an endless separation belt which is disposed at a position other than that opposed to any recording head including the recording head and is wound around the second and third rollers to be stretched between them, whose outer surface has adsorptivity lower than the adsorptivity given by the first adsorber, and which receives the recording medium from the conveyor belt and conveys the recording medium from the second roller to the third roller while supporting the recording medium on the surface thereof, wherein the recording head has a width that extends across the recording medium covering an entire width of the recording medium.

2. The image recording apparatus according to claim 1, wherein the first, second, and third rollers have a common tangent plane along and on which the recording medium is conveyed.

3. The image recording apparatus according to claim 2, further comprising a discharge tray which is disposed at a position opposite to the second roller across the third roller and at a level lower than the tangent plane, and receives the recording medium from the separation belt.

4. The image recording apparatus according to claim 2, wherein:

the conveyor belt is arranged to convey a plurality of recording media which are different in length in a direction of conveyance by the conveyor belt; and a distance between the rotation shaft of the third roller and a downstream end of the recording head which is positioned most downstream with respect to the direction of conveyance is longer than a length of a side of, among the plurality of recording media, a recording medium the side of which is longest in the direction of conveyance.

5. The image recording apparatus according to claim 1, wherein a partition which partitions the conveyor belt and the separation belt from each other is formed on the second roller.

6. The image recording apparatus according to claim 5, wherein, on the second roller, the outer surface of the conveyor belt is at a level equal to or higher than a distal end of the partition.

7. The image recording apparatus according to claim 1, wherein, on the second roller, the outer surface of the separation belt is at a level equal to or lower than the outer surface of the conveyor belt.

8. The image recording apparatus according to claim 1, wherein:

the number of at least one of the conveyor belt and the separation belt is plural; and the conveyor belt(s) and the separation belt(s) are positioned on the second roller alternately with respect to an axial direction of the second roller.

9. The image recording apparatus according to claim 8, wherein:

the number of the conveyor belt is plural; and the conveyor belts are positioned at both ends on the second roller with respect to the axial direction.

10. The image recording apparatus according to claim 8, wherein:

the number of the conveyor belt is plural; and the image recording apparatus further comprises a positioner which sets a position of a recording medium having a rectangular shape in such a manner that both sides of the recording medium extending in a direction of conveyance by the conveyor belts are placed on different ones of the conveyor belts.

11. The image recording apparatus according to claim 1, wherein the second roller is a drive roller.

12. The image recording apparatus according to claim 1, wherein the first adsorber is an adhesive layer forming the outer surface of the conveyor belt.

13. The image recording apparatus according to claim 1, wherein the first adsorber includes a plurality of through holes which are formed in the conveyor belt, and an air stream generator which generates an air stream flowing from the outer surface to an inner surface of the conveyor belt through the through holes.

14. The image recording apparatus according to claim 1, wherein:

the first adsorber is an electrification device which electrifies the conveyor belt; and the image recording apparatus further comprises a diselectrification device which diselectrifies the conveyor belt.

15. The image recording apparatus according to claim 1, further comprising a cleaner which cleans the outer surface of the conveyor belt.

16. The image recording apparatus according to claim 1, further comprising:

a moving mechanism which moves the third roller; and a switcher which, when a predetermined condition is satisfied, switches a conveyance path for the recording medium by controlling the moving mechanism so as to move the third roller.

17. The image recording apparatus according to claim 16, further comprising:

a second adsorber which improves adsorptivity of the outer surface of the separation belt; and an adsorption controller which, when the predetermined condition is satisfied, controls the second adsorber so as to improve adsorptivity of the outer surface of the separation belt

18. The image recording apparatus according to claim 16, wherein the predetermined condition is reception of a signal indicating that recording should be performed on a recording medium having a thickness not larger than a predetermined thickness.

19. The image recording apparatus according to claim 16, wherein the predetermined condition is reception of a signal indicating that double-side recording should be performed on a recording medium.

20. The image recording apparatus according to claim 16, wherein the moving mechanism moves the third roller in an arc around the rotation shaft of the second roller.

21. The image recording apparatus according to claim 16, further comprising a pair of rollers which convey the recording medium while pinching the recording medium therebetween and which are positioned on the conveyance path on a downstream of the third roller with respect to a direction of conveyance by the separation belt, wherein, along the conveyance path, a distance between a point at which the pair of rollers pinches the recording medium and a downstream end of the recording head which is positioned most downstream with respect to the direction of conveyance by the conveyor belt is longer than a length of a side of, among the plurality of recording media, a recording medium the side of which is longest in the direction of conveyance.

22. The image recording apparatus according to claim 17, wherein the predetermined condition is reception of a signal indicating that recording should be performed on a recording medium having a thickness not larger than a predetermined thickness.

* * * * *